US006194370B1

(12) United States Patent
Williams, Jr. et al.

(10) Patent No.: US 6,194,370 B1
(45) **Date of Patent: *Feb. 27, 2001**

(54) COST EFFECTIVE STAIN AND SOIL REMOVAL AQUEOUS HEAVY DUTY LIQUID LAUNDRY DETERGENT COMPOSITIONS

(75) Inventors: Johnny Williams, Jr.; Hari Achuthan Nair, both of Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/331,986

(22) PCT Filed: Dec. 9, 1997

(86) PCT No.: PCT/US97/22600

§ 371 Date: Jun. 30, 1999

§ 102(e) Date: Jun. 30, 1999

(87) PCT Pub. No.: WO98/29526

PCT Pub. Date: Jul. 9, 1998

Related U.S. Application Data

(60) Provisional application No. 60/033,963, filed on Dec. 31, 1996.

(51) Int. Cl.[7] ..... C11D 3/386

(52) U.S. Cl. ..... 510/320; 510/321; 510/355; 510/357; 510/361; 510/392; 510/393; 510/398; 510/428

(58) Field of Search ..... 510/320, 321, 510/355, 357, 361, 392, 398, 428

(56) References Cited

U.S. PATENT DOCUMENTS

| | | | | |
|---|---|---|---|---|
| 2,477,383 | | 7/1949 | Lewis | 252/161 |
| 3,723,250 | | 3/1973 | Aunstrup et al. | 195/62 |
| 4,869,150 | | 9/1989 | Post et al. | 89/11 |
| 5,332,528 | | 7/1994 | Pan et al. | 252/548 |
| 5,565,135 | | 10/1996 | Dauderman et al. | 510/281 |
| 5,587,356 | | 12/1996 | Dauderman et al. | 510/320 |
| 5,904,451 | | 5/1999 | Gerber | 408/56 |
| 5,990,065 | * | 11/1999 | Vinson et al. | 510/237 |

FOREIGN PATENT DOCUMENTS

| | | | |
|---|---|---|---|
| 0 130 756 | 1/1985 | (EP) | C12N/15/00 |
| 0 295 021 | 12/1988 | (EP) | C11D/1/83 |
| 1 296 839 | 11/1972 | (GB) | C12D/13/10 |
| WO 93/03529 | 2/1993 | (WO) | H02H/5/04 |
| WO 94/02597 | 2/1994 | (WO) | C12N/9/28 |
| WO 94/18314 | 8/1994 | (WO) | C12N/9/28 |
| WO 94/25583 | 11/1994 | (WO) | C12N/9/76 |
| WO 95/09909 | 4/1995 | (WO) | C12N/9/96 |
| WO 95/10591 | 4/1995 | (WO) | C11D/3/386 |
| WO 95/26397 | 10/1995 | (WO) | C12N/9/28 |
| WO 96/31589 | 10/1996 | (WO) | C11D/3/386 |
| WO 97/18140 | 5/1997 | (WO) | B65D/49/02 |

* cited by examiner

*Primary Examiner*—Necholus Ogden
(74) *Attorney, Agent, or Firm*—C. Brant Cook; Kim William Zerby; Steven W. Miller

(57) ABSTRACT

Cost effective stain and soil removal aqueous heavy duty liquid laundry detergent compositions are provided. Such compositions comprise relatively low levels of selected aromatic surfactant materials, certain viscosity-enhancing agents, and very large amounts of water. Only minimal amounts of other detergent composition adjuvants are permitted in such compositions.

8 Claims, No Drawings

COST EFFECTIVE STAIN AND SOIL REMOVAL AQUEOUS HEAVY DUTY LIQUID LAUNDRY DETERGENT COMPOSITIONS

This application claims the benefit of Provisional application Ser. No. 60/003,963, filed Dec. 31, 1996.

FIELD OF THE INVENTION

This invention relates to heavy duty liquid (HDL) laundry detergent products which comprise relatively small amounts of aromatic-based detersive surfactants, very large amounts of water as a liquid carrier, and minimal amounts of a relatively inexpensive viscosity-enhancing agent (thickener) which increases the viscosity of the products.

BACKGROUND OF THE INVENTION

Liquid detergent products are often considered to be more convenient to use than are dry powdered or particulate detergent products. Liquid detergents have therefore found substantial favor with consumers. Such liquid detergent products are readily measurable, speedily dissolved in the wash water, capable of being easily applied in concentrated solutions or dispersions to soiled areas on garments to be laundered and are non dusting. They also usually occupy less storage space than granular products. Additionally, liquid detergents may have incorporated in their formulations materials which could not withstand drying operations without deterioration, which operations are often employed in the manufacture of particulate or granular detergent products.

Liquid detergent products in terms of their most basic components will generally essentially comprise functional ingredients such as one or more surface active agents (surfactants) that promote and facilitate the removal of stains and soils from fabrics laundered in aqueous wash solutions formed from such liquid detergent products. Liquid detergent products will also generally contain a liquid carrier such as water which serves to dissolve or at least suspend the essential functional surfactant ingredients.

In addition to surfactants and a carrier liquid, heavy duty liquid detergent products can also contain a wide variety of additional functional ingredients which serve to boost the fabric cleaning effectiveness of the products into which they are incorporated. Such additional functional ingredients can include, for example, various detergent builders, chelating agents bleaching agents, bleach activators or catalysts, detergent enzymes, enzyme stabilizers, grease/oil solvents, dye transfer inhibition agents, pH controllers, brighteners and the like. While such additional composition components can enhance composition cleaning performance, such additional functional materials can also be relatively expensive, thereby driving up the cost of manufacture of such products and ultimately driving up the cost of such products to the consumer.

Liquid detergent products may also contain other types of additional ingredients which do not necessarily enhance the cleaning performance of such products but which may be useful for improving the physical stability or the aesthetics of such products. Such non-functional ingredients include a wide variety of materials such as hydrotropes, additional solvents, phase stabilizers, thickeners, suds suppressors, perfumes, dyes and the like. Again, while such non-functional ingredients can beneficially affect the stability or appearance of detergent products containing them, such non-functional ingredients also add cost to the product without necessarily serving to improve the fabric cleaning performance thereof.

One especially fruitful avenue for cheaply improving HDL aesthetics lies in the area of composition viscosity enhancing agents. It is, of course, advantageous to thicken dilute HDLs in order to avoid the thin, watery appearance that such highly aqueous products would normally have. Since using large amounts of thickener or using relatively expensive thickeners will undesirably drive up the cost of such HDLs, it would be advantageous to identify thickening agents which are relatively cheap and/or which can be usefully employed in relatively low concentrations. It would also be desirable to identify compounds such as certain surfactants and/or perfumes materials which, in addition to their usual function, can also serve to enhance product viscosity. HDL products which utilize relatively inexpensive thickening agents are described for example in Dauderman et al; U.S. Pat. No. 5,565,135; Issued Oct. 15, 1996 and in Dauderman et al; U.S. Pat. No. 5,587,356; Issued Dec. 24, 1996.

Given the foregoing considerations, it is highly desirable when formulating liquid detergent products to arrive at a proper balance of such competing factors as composition cost, composition cleaning performance and composition stability or aesthetics. Notwithstanding the existence of products such as those described in the '135 and '356 U.S. patents hereinbefore referenced, there remains a continuing need to identify heavy duty liquid laundry detergents with ingredients selected to provide suitably effective stain/soil removal from fabrics laundered therewith and to provide suitable product viscosity and other aesthetics while at the same time keeping the cost of such products very low. Accordingly, it is an object of the present invention to formulate heavy duty liquid laundry detergent compositions containing relatively small amounts of certain selected aromatic-based surfactants and a selected cost effective product thickening system along with very high concentrations of the most cost effective liquid detergent carrier—water.

It is a further object of the present invention to provide such liquid detergent compositions containing only minimal amounts of additional, relatively costly functional cleaning performance-enhancing ingredients.

It is the further object of the present invention to provide such liquid detergent compositions which also contain only minimal amounts of additional, relatively costly non-functional stability- or aesthetics-enhancing ingredients.

SUMMARY OF THE INVENTION

The present invention relates to thickened heavy-duty liquid laundry detergent compositions which provide very cost effective stain and soil removal performance when used in fabric laundering operations. Such compositions contain A) from about 1% to 5% by weight of an anionic surfactant component comprising alkyl benzene sulfonate; B) from about 0.2% to 10% by weight of a nonionic surfactant component comprising ethoxylated alkylphenols; C) from about 0.1% to 3% by weight of a chloride, formate or polyacrylate viscosity-enhancing agent, i.e., thickener; and D) from about 86% to 94% by weight of the composition of an aqueous non-surface active liquid carrier which comprises no more than 3% by weight of the composition of liquids other than water.

In the surfactant system, the anionic component comprises the alkali metal salts of $C_{10}$–$C_{16}$ alkyl benzene sulfonic acids and the nonionic surfactant component comprises ethoxylated alkylphenols having an alkyl moiety with from about 6 to 12 carbon atoms and an ethylene oxide content of from about 1 to 16 moles. The viscosity-enhancing agent component comprises alkali metal and alkaline earth metal chlorides and formates. Polyacrylate materials having a molecular weight of from about 500,000 to 1,000,000 can also be employed as the viscosity-enhancing agent.

Preferred compositions of the present invention contain even larger amounts of water, i.e., 88% by weight or more. Such highly preferred compositions also contain surfactant arnines, protease and amylase enzymes and certain types of perfume materials which can serve to potentiate the viscosity-enhancing performance of the thickening agents that are employed.

DETAILED DESCRIPTION OF THE INVENTION

As noted, the liquid laundry detergent compositions herein essentially contain an aromatic surfactant component, a thickener component, and a very large amount of an aqueous liquid carrier. Each of these essential components as well as optional ingredients for such compositions and methods of preparing and using such compositions are described in detail as follows: All concentrations and ratios discussed hereinafter are on a weight basis unless otherwise specified.

A) SURFACTANT COMPONENT

The detergent compositions herein contain a surfactant component which comprises an alkyl benzene sulfonate anionic surfactant and a nonionic component which comprises ethoxylated alkyl phenols. Each of these several surfactant types is discussed as follows:

Anionic Surfactant Component

The detergent compositions herein will generally comprise from about 1% to 5% by weight of an anionic surfactant component which comprises alkyl benzene sulfonates. More preferably, such compositions comprise from about 1.5% to 4.0% by weight of this anionic surfactant component, most preferably from about 1.8% to 3.5% by weight of this anionic surfactant component.

The alkyl benzene sulfonate used in the anionic surfactant component are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the alkyl group is from about 11 to 14. Sodium $C_{11}$–$C_{14}$, e.g., $C_{12}$, LAS is especially preferred.

The anionic surfactant component may also contain a number of other types of anionic surfactants in addition to the essentially utilized alkyl benzene sulfonates. A highly preferred type of optional anionic surfactant comprises ethoxylated alkyl sulfate surfactants. Such materials, also known as alkyl ether sulfates or alkyl polyethoxylate sulfates, are those which correspond to the formula:

$$R'—O—(C_2H_4O)_n—SO_3M$$

wherein R' is a $C_8$–$C_{20}$ alkyl group, n is from about 1 to 20, and M is a salt-forming cation. Preferably, R' is $C_{10}$–$C_{18}$ alkyl, n is from about 1 to 15, and M is sodium, potassium, ammonium, alkylammonium or alkanolammonium. Most preferably, R' is a $C_{12}$–$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention as hereinafter described.

In addition to the alkyl ether sulfate surfactants discussed hereinbefore, the anionic surfactant component of the compositions herein may also contain additional optional anionic surfactants so long as such additional optional anionic materials are compatible with other composition components and do not substantially adversely affect composition cost or performance, e.g., fabric cleaning performance or composition stability.

Another preferred type of optional anionic surfactant which may be used in the compositions herein comprises primary or secondary unethoxylated alkyl sulfate anionic surfactants. Such surfactants are those produced by the sulfation of higher $C_8$–$C_{20}$ fatty alcohols. Conventional primary alkyl sulfate surfactants have the general formula:

$$ROSO_3^-M^+$$

wherein R is typically a linear $C_8$–$C_{20}$ hydrocarbyl group, which may be straight chain or branched chain, and M is a water-solubilizing cation. Preferably R is a $C_{10}$–$C_{15}$ alkyl, and M is alkali metal. Most preferably R is $C_{12}$–$C_{14}$ and M is sodium.

Conventional secondary alkyl sulfates may also be utilized in the preferred anionic surfactant component of the compositions herein. Conventional secondary alkyl sulfate surfactants are those materials which have the sulfate moiety distributed randomly along the hydrocarbyl "backbone" of the molecule. Such materials may be depicted by the structure:

$$CH_2(CH_2)_n(CHOSO_3^-M^+)(CH_2)_mCH_3$$

wherein m and n are integers of 2 or greater and the sum of m+n is typically about 9 to 15, and M is a water-solubilizing cation.

Especially preferred types of secondary alkyl sulfates are the (2,3) alkyl sulfate surfactants which can be represented by structures of formulas A and B:

$$CH_2(CH_2)_x(CHOSO_3^-M^+)CH_3 \text{ and} \quad (A)$$

$$CH_3(CH_2)_y(CHOSO_3^-M^+)CH_2CH_3 \quad (B)$$

for the 2-sulfate and 3-sulfate, respectively. In formulas A and B, x and (y+1) are, respectively, integers of at least about 6, and can range from about 7 to about 20, preferably about 10 to about 16. M is a cation, such as an alkali metal, alkaline earth metal, or the like. Sodium is typical for use as M to prepare the water-soluble (2,3) alkyl sulfates, but potassium, and the like, can also be used.

Other optional anionic surfactants which may be employed include in general the carboxylate-type anionics. Carboxylate-type anionics include fatty acids, e.g., $C_{10}$–$C_{18}$, soaps, the $C_{10}$–$C_{18}$ alkyl alkoxy carboxylates (especially the EO 1 to 5 ethoxycarboxylates) and the $C_{10}$–$C_{18}$ sarcosinates, especially oleoyl sarcosinate.

Nonionic Surfactant Component

The detergent compositions herein will also comprise from about 0.2% to 10% by weight of a nonionic surfactant component. More preferably, such compositions will comprise from about 3.5% to 9.5% by weight of this nonionic surfactant component. The nonionic surfactant component of the compositions herein will essentially comprise one type of nonionic surfactant—ethoxylated alkylphenols—and may also include a number of optional nonionics. These materials are all described as follows:

i) Ethoxylated Alkylphenols

The ethoxylated alkylphenol materials essentially employed in the nonionic surfactant component of the surfactant system are those which correspond to the general formula:

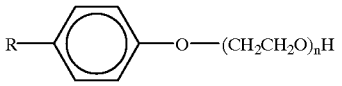

wherein R is $C_6$–$C_{12}$ alkyl group and n is from about 1 to 16. More preferably, R is a $C_8$–$C_{12}$ alkyl group and n is from about 3 to 10. Octyl, nonyl and dodecyl phenols ethoxylated with 8, 9 or 10 moles of ethylene oxide are commercially available materials and suitable for use in the compositions of the present invention.

The ethoxylated alkylphenol nonionic surfactant will frequently have a hydrophilic-lipophilic balance (HLB) which ranges from about 3 to 17. More preferably, the HLB of this material will range from about 6 to 15, most preferably from about 10 to 15.

ii) Optional Alinhatic Fatty Alcohol Ethoxylates

Aliphatic fatty alcohol ethoxylate nonionic surfactant materials may optionally be used herein along with the aromatic ethoxylated alkyl phenols. Such aliphatic materials are those which correspond to the general formula:

$$R^1(C_2H_4O)_nOH$$

wherein $R^1$ is a $C_8$–$C_{16}$ alkyl group and n ranges from about 1 to 16. Preferably $R^1$ is an alkyl group, which may be primary or secondary, that contains from about 9 to 15 carbon atoms, more preferably from about 10 to 14 carbon atoms. Preferably the ethoxylated fatty alcohols will contain from about 2 to 12 ethylene oxide moieties per molecule, more preferably from about 3 to 10 ethylene oxide moieties per molecule.

Examples of aliphatic fatty alcohol ethoxylates optionally used in the nonionic surfactant component of the compositions herein will include those which are made from alcohols of 12 to 15 carbon atoms and which contain about 7 moles of ethylene oxide. Such materials have been commercially marketed under the tradenames Neodol 25-7 and Neodol 23-6.5 by Shell Chemical Company. Other useful Neodols include Neodol 1-5, ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable aliphatic ethoxylated alcohol nonionic surfactants include Tergitol 15-S-7 and Tergitol 15-S-9, both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of aliphatic alcohol ethoxylate nonionics useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

iii) Optional Surfactant Amines

Another preferred optional ingredient of the nonionic surfactant component of the compositions herein comprises surfactant amines. Suitable surfactant amines for use herein include amines according to the formula:

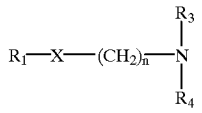

wherein $R_1$ is a $C_6$–$C_{12}$ alkyl group; n is from about 2 to about 4, X is a bridging group which is selected from NH, CONH, COO, or O or X can be absent; and $R_3$ and $R_4$ are individually selected from H, $C_1$–$C_4$ alkyl, or ($CH_2$—$CH_2$—$O(R_5)$) wherein $R_5$ is H or methyl.

Preferred surfactant amines include the following:

$R_1$—$(CH_2)_2$—$NH_2$;

$R_1$—O—$(CH_2)_2$—$NH_2$;

$R_1$—C(O)—NH—$(CH_2)_3$—$N(CH_3)_2$; and

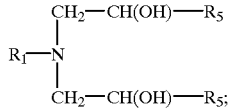

wherein $R_1$ is a $C_6$–$C_{12}$ alkyl group and $R_5$ is H or $CH_3$.

In a highly preferred embodiment, the surfactant amine is described by the formula:

$R_1$—C(O)—NH—$(CH_2)_3$—$N(CH_3)_2$ wherein $R_1$ is $C_8$–$C_{12}$ alkyl.

Particularly preferred surfactant amines include those selected from the group consisting of octyl amine, hexyl amine, decyl amine, dodecyl amines, $C_8$–$C_{12}$ bis (hydroxyethyl)amine, $C_8$–$C_{12}$ bis(hydroxyisoproyl)amine, and $C_8$–$C_{16}$, preferably $C_8$–$C_{12}$, amido-propyl dimethyl amine, and mixtures of these amines.

If used, the surfactant amine component of the nonionic surfactant will generally comprise from about 0.1% to 1.0% by weight of the composition. More preferably, the surfactant amine component will comprise from about 0.2% to 0.6% by weight of the composition.

iv) Other Optional Nonionics

In addition to the foregoing types of ethoxylated alkylphenol, aliphatic fatty alcohol ethoxylate and surfactant amnine nonionic surfactants, the nonionic surfactant component may also optionally include additional compatible, non-interfering nonionics, if cost considerations permit. These can include, for example, $C_{10}$–$C_{18}$ alkyl polyglucosides when high foaming compositions are desired; polyhydroxy fatty acid amides; ethylene oxide-propylene oxide block polymers of the Pluronic type; and the like. If utilized at all, such non-alcohol ethoxylate, non-surfactant amine optional nonionic surfactant materials should comprise no more than about 0.4% by weight of the detergent compositions herein.

One of the most preferred types of optional nonionic surfactants, besides alcohol ethoxylates and surfactant amines, comprises the polyhydroxy fatty acid amides. Such materials are more fully described in Pan/Gosselink; U.S. Pat. No. 5,332,528; Issued Jul. 26, 1994, incorporated herein by reference. These materials the general structure of the formula:

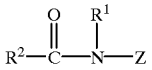

wherein $R^1$ is H, $C_1$–$C_4$ hydrocarbyl, 2-hydroxyethyl, 2-hydroxypropyl, or a mixture thereof; $R^2$ is $C_5$–$C_{31}$ hydrocarbyl; and Z is a polyhydroxylhydrocarbyl having a linear hydrocarbyl chain with at least 3 hydroxyls directly connected to the chain, or an alkoxylated derivative thereof. Examples of such surfactants include the $C_{10}$–$C_{18}$ N-methyl, or N-hydroxypropyl, glucamides. The N-propyl through N-hexyl $C_{12}$–$C_{16}$ glucamides can be used for low sudsing performance. Polyhydroxy fatty acid amides, if used, can comprise from about 0.1% to 0.4% of the compositions herein.

Cationic/Amphoteric Surfactants

In addition to the anionic and nonionic surfactants hereinbefore described, the detergent compositions herein may also contain other types of compatible surfactant materials. These include surfactants of the cationic and amphoteric types. Examples of such materials include quaternary ammonium cationics, $C_{10}$–$C_{18}$ amine oxides and the $C_{12}$–$C_{18}$ betaines and sulfobetaines. The most preferred of these optional surfactants comprises the quaternary ammonium cationics.

Quaternary ammonium cationic surfactants include of those of the formula:

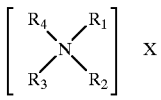

wherein $R_1$ and $R_2$ are individually selected from the group consisting of $C_1$–$C_4$ alkyl, $C_1$–$C_4$ hydroxy alkyl, and —$(C_2H_4O)_xH$ where x has a value from 2 to 5; X is an anion; and (1) $R_3$ and $R_4$ are each a $C_8$–$C_{14}$ alkyl or (2) $R_4$ is a $C_8$–$C_{22}$ alkyl and $R_3$ is selected from the group consisting of $C_1$–$C_{10}$ alkyl, $C_1$–$C_{10}$ hydroxy alkyl, and —$(C_2H_4O)_xH$ where x has a value from 2 to 5.

Preferred of the above are the mono-long chain alkyl quaternary ammonium surfactants wherein the above formula $R_1$, $R_2$, and R3 are each methyl. and $R_4$ is a $C_8$–$C_{18}$ alkyl. The most preferred quaternary ammonium surfactants are the chloride, bromide and methylsulfate $C_8$–$C_{16}$ alkyl trimethyl ammonium salts, and $C_8$–$C_{16}$ alkyl di(hydroxyethyl)-methyl ammonium salts. Of the above, lauryl trimethyl ammonium chloride, myristyl trimethyl ammonium chloride and coconut trimethylammonium chloride and methylsulfate are particularly preferred. ADOGEN 412™, a lauryl trimethyl ammonium chloride commercially available from Witco, is a preferred quaternary ammonium cationic surfactant.

Quaternary ammonium cationic surfactants of the foregoing type are known to be useful in detergent compositions as fabric softening agents. However, such materials, if used in the compositions of the present invention, are generally used at concentrations below those useful for such materials to provide fabric softening effects. When employed at concentrations of from about 0.1% to 1% by weight, more preferably from about 0.4% to 0.8% by weight of the composition, such quaternary ammonium cationics will provide a grease/oil soil removal performance benefit without undesirably driving up the cost of the compositions herein. When employed in these relatively low concentrations, such quaternary ammonium cationics can also act as thickeners which increase the viscosity of the liquid detergent compositions herein.

C) VISCOSITY-ENHANCING AGENT COMPONENT

The third essential component of the liquid detergent compositions herein comprises one or more relatively low cost viscosity-enhancing agents. Such viscosity-enhancing agents, i.e., thickeners, will generally comprise from about 0.05% to 3% by weight of the compositions herein, more preferably, from about 0.1% to 2% by weight of the compositions herein.

The relatively low cost viscosity-enhancing agents which are especially suitable for use in the highly aqueous liquid detergents of this invention can include halide and formate salts as well as polyacrylic co-polymers. Combinations or mixtures of these types of viscosity-enhancing agents can also be employed.

Suitable halide and formate salts which may be utilized include the alkali metal, alkaline earth metal and magnesium salts of halides and formates. Examples of such materials include sodium chloride, potassium chloride, calcium chloride, magnesium chloride, sodium bromide, sodium formate, calcium formate, and magnesium formate. Sodium chloride, sodium formate, and calcium formate are the most preferred.

The polyacrylic co-polymers which may be utilized as viscosity-enhancing agents are those having a molecular weight of from about 500,000 to 1,000,000. more preferably from about 750,000 to 1,000,000. Suitable co-monomers for use in preparing these materials include methacrylic acid and ethylene oxide. These polyacrylic thickeners may or may not be cross-linked. Examples of suitable polyacrylic copolymer thickening agents include those marketed under the tradenames Acusol 820 and Acusol 880 by Rohm and Haas Company.

D) AQUEOUS LIQUID CARRIER

The fourth essential component of the liquid detergent compositions herein comprises an aqueous, non-surface active liquid carrier. Since the objective of the present invention is to utilize as little as possible of the functional detergent composition components, the amount of the aqueous, non-surface active liquid carrier employed in the compositions herein will be very large. Generally, the non-aqueous, non-surface active liquid carrier component will comprise from about 86% to 94% by weight of the compositions herein. More preferably this liquid carrier component will comprise from about 88% to less than 90% by weight of the compositions herein.

The most cost effective type of aqueous, non-surface active liquid carrier is, of course, water itself. Accordingly, the aqueous, non-surface active liquid carrier component will generally be mostly, if not completely, comprised of water. While other types of water-miscible liquids, such alkanols, diols, other polyols, ethers, amines, and the like, have been conventionally been added to liquid detergent compositions as co-solvents or stabilizers, for purposes of the present invention, the utilization of such water-miscible liquids should be minimized, if not eliminated. Thus, the aqueous, non-surface active liquid carrier component of the compositions herein will generally contain no more than about 3% by weight of the composition of liquids other than water. Preferably, the liquid carrier will contain no more than about 2% by weight of the composition of liquids other than water.

E) OPTIONAL DETERGENT COMPOSITION INGREDIENTS

The detergent compositions of the present invention can also include any number of additional optional ingredients. These include conventional detergent composition components such as builders, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme stabilizers (such as propylene glycol, boric acid and/or borax), hydrotropes, additional thickeners, dye transfer inhibiting agents, brighteners and perfumes, including perfume which may promote thickening of the liquid detergent products herein. In keeping with the purpose of the present invention, such optional ingredients, if used, must be incorporated at relatively low levels, and indeed at levels generally below those at which they are conventionally employed if cost effective compositions are to be realized. Accordingly, if used, such optional ingredients will generally comprise no more than about 5%, i.e., from about 0.001% to 4%, by weight of the compositions herein. A few of the optional ingredients which can be used are described in greater detail as follows:

i) Detergent Enzymes

A preferred optional component of the compositions herein comprises detergent enzyme material that contains one or more protease enzymes and one or more amylase enzymes. Such an enzyme component will generally comprise from about 0.05% to 0.5% by weight of the compositions herein, more preferably from about 0.15% to 0.4% by weight of the compositions herein. Within this enzyme component, one or more protease enzyme materials will generally be present in an amount sufficient to provide from about 0.005 to 0.1 Anson units (AU) of protease activity per gram of composition. Amylase enzyme materials will be present to the extent of from about 0.01% to 0.1% by weight of the composition.

Examples of suitable proteases are the subtilisins which are obtained from particular strains of *B. subtilis* and *B. licheniforms*. Such protease enzymes are described in greater detail in GB 1,243,784; EP 130,756A; EP 303,761A; WO 97/18140A; WO 93/03529A; WO 95/10591A; WO 95.07791; and WO 94/25583. All of these patent publications are incorporated herein by reference. Suitable protease materials are marketed under the tradenames Esperase® (Novo), Alcalase® (Novo), Savinase® (Novo) and Maxatase® (International Bio-Synthetics).

Amylases (α and β) may be used for removal of carbohydrate-based stains. These amylase enzymes may be of any subtilisin origin such as vegetable, animal, bacterial, fungal or yeast origin. Amylase enzymes are described in greater detail in WO 95/26397A; GB 1,296,839; WO 94/02597A; WO 94/18314; and WO 95/09909A. All of these patent publications are incorporated herein by reference. Suitable amylase materials are marketed when the tradenames Termamyl® (Novo), Fungamyl® (Novo), BAN® (Novo), Rapidase® (International Bio-Synthetics) and Duramyl® (Novo).

Other types of detergent enzymes have also been widely employed in detergent compositions. Such enzymes as lipases, cellulases, and peroxidases are well known. It is possible to add one or more of these non-protease, non-amylase types of enzymes to the detergent compositions herein the improve the effectiveness of the composition in removing certain types of soils/stains. However, for purposes of the present invention, it has been determined that the incorporation of these non-protease, non-amylase enzyme types into the compositions herein is not especially cost effective. Accordingly, the enzyme component of the detergent compositions of this invention will generally contain no more than about 0.01% by weight of the composition of non-protease, non-amylase enzyme materials.

ii) Optional Organic Detergent Builders

The detergent compositions herein may also optionally contain low levels of an organic detergent builder material which serves to counteract the effects of calcium, or other ion, water hardness encountered during laundering/bleaching use of the compositions herein. Examples of such materials include the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids $C_{10}$–$C_{22}$ fatty acids and citric acid. Other examples are organic phosphonate type sequestering agents such as those which have been sold by Monsanto under the Dequest tradename and alkanehydroxy phosphonates. Citrate salts and $C_{12}$–$C_{18}$ fatty acid soaps are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

If utilized, optional organic builder materials will generally comprise from about 0.1% to 3%, more preferably from about 0.1% to 2%, most preferably from about 0.1% to 0.4%, by weight of the compositions herein. Even at such concentrations which are generally lower than those conventionally utilized, organic builders can serve to enhance the cost effective fabric laundering performance of the liquid detergent compositions herein.

iii) Enzyme Stabilizers

The detergent compositions herein may also optionally contain low levels of materials which serve to maintain the stability of the enzyme materials of the enzyme component. Such enzyme stabilizers can include, for example, polyols such as propylene glycol. boric acid and borax. Combinations of these enzyme stabilizers may also be employed. If utilized, enzyme stabilizers can comprise from about 0.1% to 1.0% by weight of the compositions herein.

iv) Phase Stabilizers/Co-solvents

The detergent compositions herein may also optionally contain low levels of materials which serve as phase stabilizers and/or co-solvents for the liquid compositions herein. Materials of this type include $C_1$–$C_3$ lower alkanols such as methanol, ethanol and/or propanol. Lower $C_1$–$C_3$ alkanolamines such as mono-, di- and triethanolamines can also be used, by themselves or in combination with the lower alkanols. If utilized, phase stabilizers/co-solvents can comprise from about 0.1% to 0.5%by weight of the compositions herein.

v) pH Control Agents

The detergent compositions herein may also optionally contain low levels of materials which serve to adjust or maintain the pH of the aqueous detergent compositions herein at optimum levels. The pH of the compositions of this invention should range from about 7.8 to 11, more preferably from about 8.0 to 9.0. Materials such as NaOH can be added to alter composition pH, if necessary.

vi) Perfumes

Perfumes may be added to the compositions herein for their conventional purpose, i.e. to improve the aesthetics of the products by providing a pleasant odor to the liquid products, both before and during use. Certain types of perfume compounds, in addition to acting as perfumes, also serve to unexpectedly enhance the viscosity of the preferred highly aqueous, formate-containing detergent compositions herein. Not all conventional perfume compounds act in this way but a number of conventional ones do. The perfume component of the compositions herein will comprise about 0.01% to 0.5% by weight of the composition. More preferably, the perfume compounds will comprise from about 0.1% to about 0.4% by weight of the compositions herein.

The perfume compounds which are preferred for use in the compositions herein are those which significantly enhance the viscosity of a certain type of surfactant-containing, formate-containing aqueous test composition. Such an aqueous test composition is one which is similar to those of the present invention and which comprises from about 11% to 14% (e.g. about 12%) surfactant which includes about 0.5% lauryl trimethyl ammonium chloride, from 1% to 2% (e.g., about 1.25%) sodium formate and about 0.3% of the perfume compound(s). Preferred for use in the compositions herein are these perfume compound(s) which in such a test composition increase the Brookfield viscosity of such a composition over that of the test composition containing no perfume compound(s) and to a value of about 140 cps or higher. More preferably, the perfume compound(s) preferred for use in this invention will increase the test composition viscosity to value of about 165 cps or higher.

The procedure for evaluating perfume compounds in this test composition is desired in greater detail in Example III hereinafter. As is described in Example III, a number of common perfume compounds meet the viscosity-enhancing test described therein and accordingly are preferred for use in the compositions herein. These include the perfume materials described as follows in Table A.

TABLE A

| Common Name | Chemical Name | Formula |
|---|---|---|
| benzyl salicylate | benzyl o-hydroxy benzoate | 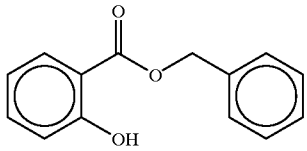 |
| citronellol | 3,7-dimethyl-6-octen-1-ol | 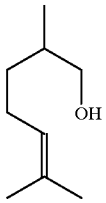 |
| citronellal nitrile | 3,7-dimethyl-6-octene nitrile | 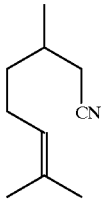 |
| p.t. bucinal | p,t-butyl-α-methyl hydrocinnamic aldehyde | 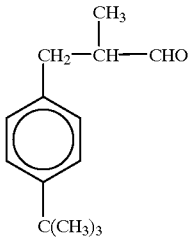 |

TABLE A-continued

| Common Name | Chemical Name | Formula |
|---|---|---|
| hexyl cinnamic aldehyde or jasmonal H | α-n-hexyl cinnamic aldehyde | 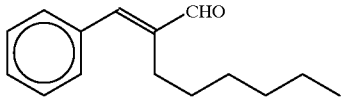 |
| flor acetate or cyclacet | hexahydro-4,7-methano-iden-5(or 6)-yl acetate | 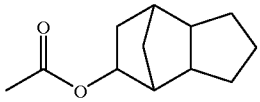 |
| linalool | 3,7-dimethyl-1,6-octadien-3-ol | 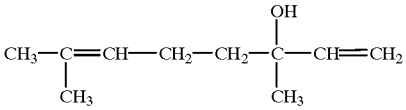 |

F) COMPOSITION FORM, PREPARATION AND USE

The liquid detergent compositions herein are in the form of an aqueous solution or uniform dispersion or suspension of surfactants, thickeners, and certain optional other ingredients, many of which are normally in solid form, that have been combined with the normally liquid components of the composition such as the liquid alcohol ethoxylate nonionic, the aqueous liquid carrier, and any other normally liquid optional ingredients such as perfume. Such a solution, dispersion or suspension will be acceptably phase stable and will typically have a viscosity which ranges from about 100 to 300 cps, more preferably from about 150 to 250 cps. For purposes of this invention, viscosity is measured with a Brookfield LVTDV-11 viscometer apparatus using an RV #2 spindle at 12 rpm.

The aqueous liquid detergent compositions herein can be prepared by combining the essential and optional components thereof in any convenient order and by mixing, e.g., agitating, the resulting component combination to form the thickened, phase stable compositions herein. In a preferred process for preparing such compositions, essential and certain preferred optional components will be combined in a particular order. In such a preferred preparation process, a liquid matrix is formed containing at least a major proportion, and preferably substantially all, of the liquid components, e.g., the alcohol ethoxylate nonionic surfactant, the aqueous, non-surface active liquid carrier and other optional liquid components with the liquid components being thoroughly admixed by imparting shear agitation to this liquid combination. For example, rapid stirring with a mechanical stirrer may usefully be employed.

While shear agitation is maintained, substantially all of the preferred anionic surfactants, viscosity-enhancing agents, preferred cationic surfactants, and optional builders can be added in the form of particles ranging in size from about 0.2 to 1,000 microns. Agitation of the mixture is continued, and if necessary, can be increased at this point to form a solution or a uniform dispersion of insoluble solid phase particulates within the liquid phase.

After some or all of the solid-form materials have been added to this agitated mixture, the particles of the preferred enzyme material, e.g., enzyme prills, are incorporated. Thus the enzyme component is preferably added to the aqueous liquid matrix last.

As a variation of the composition preparation procedure hereinbefore described, one or more of the solid components may be added to the agitated mixture as a solution or slurry of particles premixed with a minor portion of one or more of the liquid components. In another variation of the preparation procedure, the viscosity-enhancing agent may be added by combining it with the anionic surfactant during preparation of the preferred anionic surfactant component. In this way, the formate viscosity-enhancing agent (such as sodium formate) can be introduced into the compositions herein via the anionic surfactant when the anionic is combined with the rest of the detergent composition components.

After addition of all of the composition components, agitation of the mixture is continued for a period of time sufficient to form compositions having the requisite viscosity and phase stability characteristics. Frequently this will involve agitation for a period of from about 30 to 60 minutes.

The compositions of this invention, prepared as hereinbefore described, can be used to form aqueous washing solutions for use in the laundering of fabrics. Generally, an effective amount of such compositions is added to water, preferably in a conventional fabric laundering automatic washing machine, to form such aqueous laundering solutions. The aqueous washing solution so formed is then contacted, preferably under agitation, with the fabrics to be laundered therewith.

An effective amount of the liquid detergent compositions herein added to water to form aqueous laundering solutions can comprise amounts sufficient to form from about 500 to 7,000 ppm of composition in aqueous washing solution. More preferably, from about 1,000 to 3,000 ppm of the detergent compositions herein will be provided in aqueous washing solution.

EXAMPLES

The following examples illustrate the compositions of the present invention but are not necessarily meant to limit or otherwise define the scope of the invention herein.

Example I

A composition of the present invention is prepared by mixing together the ingredients listed in Table I in the proportions shown.

TABLE I

| Liquid Detergent Composition | |
|---|---|
| Component | Wt. % Active |
| Sodium $C_{11-14}$ alkyl benzene sulfonate | 2.0 |
| $C_{12-16}$ Alkylphenol Ethoxylate* (EO = 9) | 9.0 |
| NaOH (50%) | 0.30 |
| Protease Enzyme (34 g/l) | 0.20 |
| Amylase Enzyme | 0.05 |
| Calcium Formate | 0.07 |
| Sodium Formate (30%) | 0.02 |
| Perfume comprising benzyl salicylate | 0.30 |
| Water | 88.1 |
| | 100% |

*Surfonic N-95

The Table I liquid detergent composition provides very effective fabric cleaning performance when used to form aqueous wash solutions for conventional fabric laundering operations. Such performance is provided and the composition is stable, even though the composition is relatively low cost due to the incorporation of only very small amounts of the aromatic surfactants and other composition adjuvants. By virtue of the use of sodium and calcium formate and benzyl salicylate-based perfume in the Table I composition, this liquid detergent product is also thick enough to be utilized as a pretreat product when it is applied full strength directly onto fabric stains prior to laundering of the stained fabrics. Compositions of substantially similar viscosity characteristics can be realized if, in the Table I composition, the perfume is replaced with an equivalent amount of other perfumes which comprise citronellol, citronellal nitrile, hexyl cinnamic aldehyde flor acetate, p.t. bucinal or linalool.

Example II

The Example I composition is tested for its ability to remove selected types of enzyme sensitive stains from soiled fabrics. Such testing compares stain removal performance, both Through-the-Wash (TTW) and Pre-Treat (PT), with a similar highly aqueous, but higher cost, detergent composition which is described in Example I in a related, commonly assigned, copending U.S. application having U.S. Ser. No. 08/744,721; filed Oct. 29, 1996. This Example I composition of U.S. Ser. No. 08/744,721 uses a different, non-aromatic surfactant system in contradistinction to the product of Example I herein. Furthermore, the U.S. Ser. No. 08/744,721 product is not as dilute (water content=83.7%) as the compositions of this invention.

Image Analysis testing shows the relative stain removal performance between the product described in U.S. Ser. No. 08/744,721-Example I and the above Example I product. Results are shown in Table II:

TABLE II

| Stain Removal Performance (Image Analysis-90° F., 6 grains per gallon) | | |
|---|---|---|
| Bold number = 95% statistical significance | USSN '721 Example I | Example I above |
| TTW | | |
| Clay | 49 | 46 |
| Choc Pudding | 84 | 88 |
| Gravy | 70 | 70 |
| Bacon Grease | 79 | 88 |

TABLE II-continued

| Stain Removal Performance (Image Analysis-90° F., 6 grains per gallon) | | |
|---|---|---|
| Bold number = 95% statistical significance | USSN '721 Example I | Example I above |
| PT | | |
| Grass | 93 | 89 |
| Blood | 89 | 86 |
| Choc Pudding | 87 | 91 |
| Gravy | 70 | 85 |
| Hamburger Grease | 78 | 83 |

The Table II data indicate, that for the stains tested, the Example I product of the present invention provides comparable (and, for several types of stains, superior) stain removal performance relative to a similar product which is higher cost and not as dilute.

Example III

This example illustrates a procedure for determining the relative effectiveness of various perfume compounds at enhancing the viscosity of preferred formate-containing, highly aqueous liquid laundry detergent products of this invention. In such a procedure, a formate-containing base liquid detergent test composition is prepared and is spiked with 0.3% by weight of a number of conventional perfume compounds or other reference components. Such a spiked test composition is well-mixed using a vortexer and is held at 21° C. (70° F.) for 36 hours. The viscosity of each of the spiked compositions is then measured with a Brookfield LVTDV-11 viscometer using a #2 spindle at 12 rpm.

The test compositions have the formula shown in Table III.

TABLE III

| Component | Wt. % Active |
|---|---|
| Total Surfactant | 12.2 |
| (Surfactant Component) | (Wt. % Active) |
| $C_{12-14}$ Alkyl polyethoxylate (3.0) sulfonic acid (27%) | 5.25 |
| $C_{12-14}$ Alkyl sulfate | 5.25 |
| $C_{12-13}$ Alcohol ethoxylate* (EO = 9) | 1.0 |
| $C_{12-14}$ N-methyl glucamide | 0.2 |
| Lauryl trimethyl ammonium chloride** (37%) | 0.5 |
| Component | Wt. % Active |
| Citric acid (50%) | 0.75 |
| Protease Enzyme (34 g/l) | 0.23 |
| Propylene Glycol | 0.29 |
| Monoethanolamine | 0.32 |
| Borax (38%) | 0.63 |
| Ethanol (97%) | 0.04 |
| NaOH (50%) | 1.51 |
| Sodium Formate | 1.25 |
| Minors (Brightener, Preservative, Dye, Suds Suppressor) | 0.14 |
| Perfume Compound or Other Test Material | 0.3 |
| Water | 82.34 |
| Total | 100% |

*Neodol 23-9
**Adogen 412

Viscosity characteristics of the Table III test compositions having various Perfume Compound or Other Test Material components are set forth in Table IV.

TABLE IV

| Perfume Compound or Other Test Material | Brookfield Viscosity (cps) |
|---|---|
| Citronellol | 284.0 |
| Hexyl Cinnamic Aldehyde | 240.0 |
| Citronellol Nitrile | 230.0 |
| P.T. Bucinal | 229.0 |
| Linalool | 200.0 |
| Benzyl Salicylate | 163.0 |
| Cyclal C | 155.0 |
| Flor Acetate | 145.0 |
| Frutene | 145.0 |
| Cis-3-Hexenyl Salicylate | 135.0 |
| Linalyl Acetate | 125.0 |
| Prenyl Acetate | 100.0 |
| Phenyl Ethyl Alcohol | 83.0 |
| Galaxolide | 80.5 |
| $H_2O$ | 47.0 |
| Dipropylene Glycol | 42.6 |

The Table IV viscosity testing data indicate that some common perfume compounds are especially effective at enhancing the thickening of formate-containing, highly aqueous liquid detergent products. Such relatively effective thickening perfumes can, in general, be characterized as aldehydes, nitrites, ketones and secondary alcohols. Other common perfume compounds are not nearly as effective at thickening these compositions. These tend to be esters and primary alcohols.

The perfume compounds which are preferably employed in the present invention are those which increase the viscosity (in comparison with the $H_2O$ test material) of detergent compositions of the Table III type to a value of 140 cps or higher.

What is claimed is:

1. A highly aqueous, heavy duty liquid laundry detergent composition which provides cost effective stain and soil removal performance when used in fabric laundering operations and which is of acceptable viscosity for use in home fabric laundering operations, said composition comprising:

(A) from 1% to 5% by weight of the composition of an anionic surfactant component which comprises alkali metal salts of $C_{10}$–$C_{16}$ alkyl benzene sulfonic acids;

(B) from 0.2% to 10% by weight of the composition of a nonionic surfactant component which comprises ethoxylated alkyl phenols of the formula

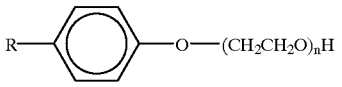

wherein R is a $C_6$–$C_{12}$ alkyl group and n is from 1 to 16;

(C) from 0.1% to 3% by weight of the composition of a viscosity-enhancing agent component comprising alkali metal and alkaline earth metal chlorides and formates, polyacrylic compositions having a molecular weight of from 500,000 to 1,000,000 and combinations of said viscosity-enhancing agents;

(D) from 86% to 94% by weight of the composition of an aqueous, non-surface active liquid carrier which comprises no more than 3% by weight of the composition of liquids other than water; and (E) from 0.001% to 4% by weight of a suds suppressor.

2. A composition according to claim 1 wherein (A) the alkyl benzene sulfonic is sodium linear $C_{11-14}$ alkyl benzene sulfonate;

(B) the ethoxylated alkylphenol contains from 8 to 12 carbon atoms in the alkyl group and from 3 to 10 moles of ethylene oxide;

(C) the composition additionally contains from 0.1% to 1.0% by weight of the composition of a surfactant amine having the formula:

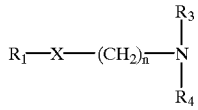

wherein $R_1$ is a $C_6$–$C_{12}$ alkyl group n is from 2 to 4, X is a bridging group which is selected from NH, CONH, COO, or O or X can be absent; and $R_3$ and $R_4$ are individually selected from H, $C_1$–$C_4$ alkyl, or ($CH_2$—$CH_2$—O($R_5$)) wherein $R_5$ is H or methyl; and (D) the viscosity-enhancing agent is selected from sodium formate, calcium formate and mixtures thereof.

3. A composition according to claim 2 which additionally contains from 0.05% to 0.5% by weight of an enzyme component comprising both protease and amylase enzymes.

4. A composition according to claim 3 which additionally contains from 0.1% to 1% by weight of the composition of one or more enzyme stabilizing agents selected from propylene glycol, boric acid, and borax.

5. A composition according to claim 2 which additionally contains from 0.01% to 0.5% by weight of the composition of one or more perfume compounds which alone or in combination increase the Brookfield viscosity of an aqueous composition comprising from 11% to 14% surfactant including 0.5% lauryl trimethyl ammonium chloride, from 1% to 2% sodium formate and 0.3% perfume, to a value of 140 cps or higher.

6. A composition according to claim 2 which additionally contains from 0.1% to 3% by weight of the composition of a carboxylate detergent builder selected from $C_{10}$–$C_{22}$ fatty acids and their salts and citric acid and its salts.

7. A highly aqueous, heavy duty liquid laundry detergent composition which provides cost effective stain and soil removal performance when used in fabric laundering operations and which is of acceptable viscosity for use in home fabric laundering operations, said composition comprising:

(A) from 1.5% to 4.0% by weight of the composition of an anionic surfactant component which comprises sodium $C_{11}$–$C_{14}$ alkylbenzene sulfonates;

(B) from 3.5% to 9.5% by weight of the composition of a nonionic surfactant component which comprises ethoxylated $C_8$–$C_{12}$ alkylphenols containing from 3 to 10 moles of ethylene oxide;

(C) from 0.1% to 2% by weight of the composition of a carboxylate detergency builder selected from $C_{10}$–$C_{22}$ fatty acids and their salts and citric acid and its salts;

(D) from 0.05% to 0.5% by weight of the composition of an enzyme component which comprises one or more protease detergent enzymes; one or more amylase detergent enzymes or combinations of both protease and amylase enzymes but contains no more than 0.01% by weight of said composition of enzymes other than protease and amylase enzymes;

(E) from 0.1% to 2% by weight of the composition of a sodium chloride, sodium formate or calcium formate viscosity-enhancing agent; p1 (F) from 88% to less than 90% by weight of the composition of an aqueous, non-surface active liquid carrier which comprises no more than 2% by weight of the composition of liquids other than water; and (G) from 0.001% to 4% by weight of a suds suppressor.

8. A composition according to claim 7 which additionally contains from 0.1% to 0.4% by weight of the composition of perfume compounds selected from benzyl salicylate, citronellol, citronellal nitrile, p.t. bucinal, flor acetate, linalool, hexyl cinnamic aldehyde and combinations thereof.

* * * * *